United States Patent [19]

Morrison

[11] Patent Number: 4,701,071

[45] **Date of Patent: * Oct. 20, 1987**

[54] PORTABLE SCREED

[76] Inventor: Donald R. Morrison, 6228 Eagle Peak Dr., Charlotte, N.C. 28214

[ * ] Notice: The portion of the term of this patent subsequent to Mar. 17, 2004 has been disclaimed.

[21] Appl. No.: 3,746

[22] Filed: Jan. 16, 1987

Related U.S. Application Data

[63] Continuation-in-part of Ser. No. 888,522, Jul. 23, 1986, Pat. No. 4,650,366.

[51] Int. Cl.[4] ..... E01C 19/38

[52] U.S. Cl. ..... 404/114; 404/119; 425/456; 425/458

[58] Field of Search ..... 404/96, 97, 114, 118–120; 425/456, 458

[56] References Cited

U.S. PATENT DOCUMENTS

| | | | |
|---|---|---|---|
| 3,435,740 | 4/1969 | McGall | 404/96 |
| 4,030,873 | 6/1977 | Morrison | 404/114 X |
| 4,261,694 | 4/1981 | Morrison | 404/119 X |
| 4,340,351 | 7/1982 | Owens | 404/120 X |
| 4,349,295 | 9/1982 | Morrison | 404/114 |
| 4,375,351 | 3/1983 | Allen | 404/119 X |
| 4,386,901 | 6/1983 | Morrison | 404/118 X |
| 4,397,580 | 8/1983 | Morrison | 404/114 X |
| 4,397,626 | 8/1983 | Morrison | 404/114 X |
| 4,427,358 | 1/1984 | Stilwell | 404/120 X |
| 4,577,994 | 3/1986 | Miller | 404/119 X |
| 4,650,366 | 3/1987 | Morrison | 404/114 |

FOREIGN PATENT DOCUMENTS

| | | | |
|---|---|---|---|
| 1213908 | 4/1960 | France | 404/96 |

*Primary Examiner*—Stephen J. Novosad
*Assistant Examiner*—John F. Letchford
*Attorney, Agent, or Firm*—B. B. Olive

[57] ABSTRACT

A concrete screed comprising an elongated beam with top and bottom flat surfaces joined to an intermediate hollow, tubular cylindrical section, formed of a plurality of interconnected separable beam units. Each adjacent pair of beam units is interconnected by a tongue body of a size and shape adapting it to closely fit within passages at end portions of the adjacent beam units, such passages being formed corporately by the bottom flat plate, the tubular section, and generally vertical ribs joining the bottom plate portion to the tubular section. The tongue body is secured to each of the adjacent beam units, with its respective ends disposed within the respective passages of the adjacent beam unit. The screed comprises means for imparting vibrations to the second plate portion, and a handle connected to the first plate portion.

In a further embodiment, the screeding apparatus features turnbuckle assemblies associated with first plate members of adjacent beam units, whereby the attitude of the adjacent beam units relative to one another may readily be adjusted to a selected relationship.

2 Claims, 5 Drawing Figures

PORTABLE SCREED

REFERENCE TO RELATED APPLICATION

This application is a continuation-in-part of U.S. patent application Ser. No. 888,522, filed July 23, 1986, in the name of Donald R. Morrison for "Portable Screed" now U.S. Pat. No. 4,650,366.

BACKGROUND OF THE INVENTION

1. Field of the Invention:

This invention relates to concrete screeding apparatus and particularly to portable vibrating screeds for screeding relatively narrow wet concrete confined by forms such as for sidewalks, patio sections, and the like.

2. Description of the Related Art:

Applicant's prior U.S. Pat. No. 4,386,901 discloses a concrete screeding apparatus featuring a loose bearing mounted vibrating shaft supported within an elongated open frame. The apparatus of this patent is highly maneuverable in character, and is particularly useful with so-called wet or "mud" type screeding in which forms are not available or used.

Applicant's copending U.S. patent application Ser. No. 888,522, filed July 23, 1986, and entitled, "Portable Screed", the disclosure of which is hereby incorporated by reference, discloses a lightweight, portable vibrating concrete screed composed of a base unit and a selected number of attached extension units. Each unit incorporates an extruded member housing a vibrating shaft within the extrusion and forming a screed surface. A small gasoline engine mounts on a plate forming a part of the base unit extrusion and drives the vibrating shaft. Handles are secured at selected points on selected ones of the extruded members for guiding and propelling the screed.

The aforementioned copending application also discloses various prior art screeds having some form of extrusion as a structural element, including U.S. Pat. Nos. 2,542,979; 2,693,136; 3,095,789; and 4,105,355, the teachings of which are more fully described in said application.

At page 5, lines 15–16 of applicant's copending application Ser. No. 888,522, it is disclosed to connect a base screed unit to screed extension units by means of straps which are secured by bolts. Such mode of connecting the respective adjacent screed units, while simple in construction and readily effected, has the associated disadvantage that the vibrations produced in the extruded units are transmitted to such connections, so that after a period of sustained or intermittent extended use, as a result of the transmitted vibrations, the bolts securing the straps may loosen, so that uncoupling of the connected screed units occurs.

Another disadvantage of the portable screed of the aforementioned copending application is that when a plurality of screed extension units are connected to the base screed unit to provide a screed apparatus of substantial length, there is a tendency, by virtue of the weight of the respective extension units, for the extension units to be deflected from a longitudinal alignment with the base screed unit. This effect may be particularly pronounced in extended length screed assemblies, where progressively increasing "droop" of successively outer extension units produces a marked overall deviation from the desired linear profile.

Accordingly, it is an object of the present invention to provide an improved portable screed of the general type disclosed in the aforementioned copending application, which however is not susceptible in operation to the deficiencies noted above.

It is another object of the present invention to provide a portable, lightweight screed of the aforementioned type, in which adjacent screed units are connected to one another by means which are highly resistant in use to loosening from vibration generated in the screed assembly and transmitted through the structure thereof.

It is yet another object of the invention to provide a portable, lightweight screed of the aforementioned type, which is resistant to the aforementioned progressive "droop" phenomenon, and specifically employs means which allow adjustment of the attitude of adjacent sections relative to one another, whereby predetermined desired surface profiles of the concrete being screeded are readily obtained.

Other objects and advantages of the present invention will be more fully apparent from the ensuing disclosure and appended claims.

SUMMARY OF THE INVENTION

The concrete screed of the present invention comprises an elongated beam with top and bottom flat surfaces joined to an intermediate hollow, tubular cylindrical section. The top plate portion provides a mounting surface for attachment of handle means to the screed, and the bottom flat plate portion provides a screeding surface.

The beam comprises a plurality of interconnected separable beam units, in which each adjacent pair of beam units is connected to one another by a tongue body of a size and shape adapting it to closely fit within passages at end portions of the adjacent beam units, such passages being formed corporately by the bottom flat plate, the tubular section, and generally vertical ribs joining the bottom plate portion to the tubular section. The tongue body is secured to each of the adjacent beam units, with its respective ends disposed within the respective passages of the adjacent beam units, optionally permanently secured at one end and detachably secured at the other end. This screed comprises means for imparting vibrations to the second plate portion, and a handle connected to the first plate portion.

The above-described screeding apparatus thus features adjacent beam units which may readily be assembled and disassembled to provide a selected length for the elongated beam in use, thereby readily adapting the screeding apparatus to a wide variety of screeding applications.

In a further aspect of the screeding apparatus of the present invention, as generally described above, supports may be mounted on end portions of the first plate members of adjacent beam units, with threaded rods secured to and extending longitudinally from the supports and a turnbuckle nut threaded complementarily to the threaded rods and mated at its respective ends therewith, whereby the attitude of the adjacent beam units relative to one another may readily be adjusted to a selected relationship.

Other aspects of the invention will be more fully apparent from the ensuing disclosure and appended claims.

DETAILED DESCRIPTION OF THE INVENTION, AND PREFERRED EMBODIMENTS THEREOF

Figure 1:
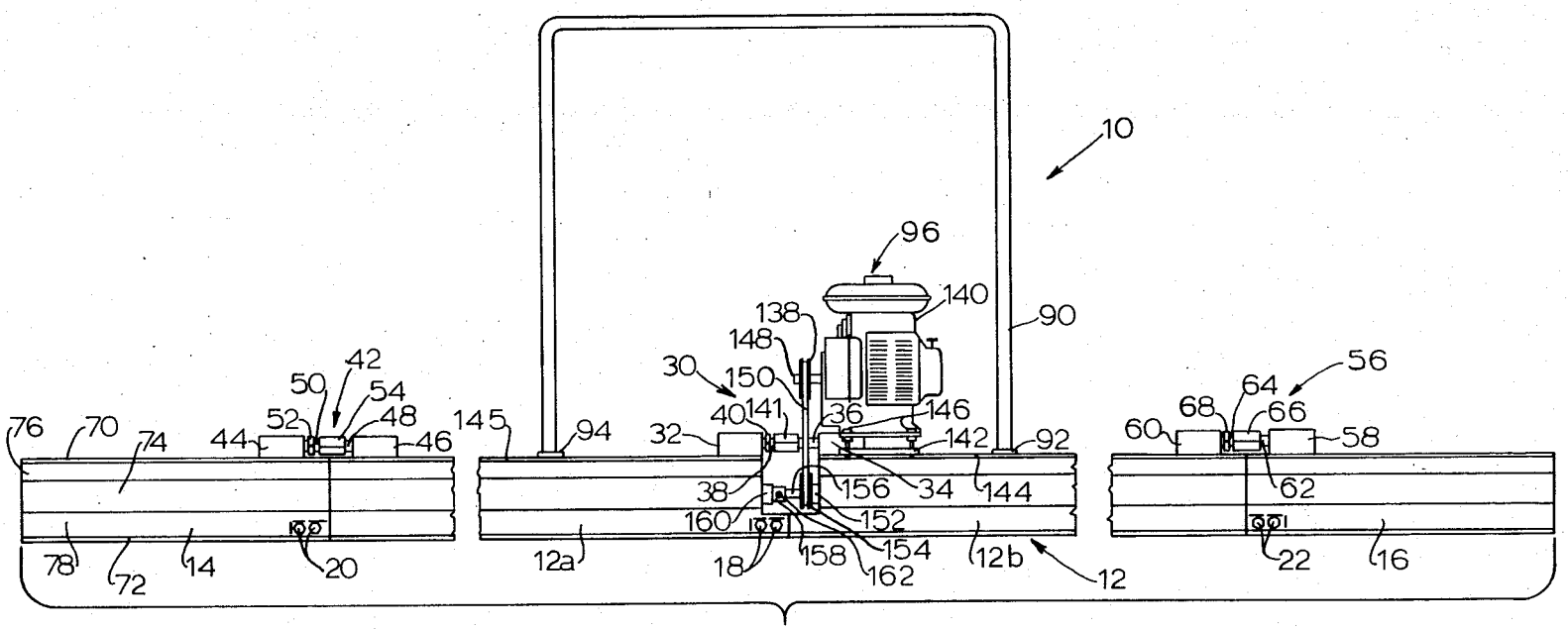
FIG. 1 is an elevation view of a screed apparatus according to one embodiment of the present invention.
Figure 3:
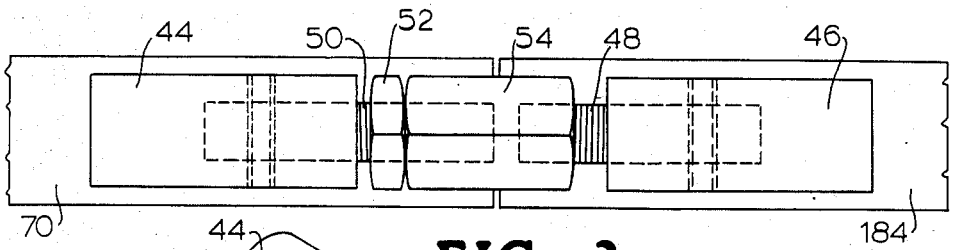
FIG. 3 is a top plan view of the FIG. 2 assembly.

Making reference to the drawings, screed 10 according to one embodiment of the present invention comprises a beam 12 of elongated form, which in turn comprises a central beam unit formed by beam units 12*a* and 12*b*, coupled to one another by bolt fasteners 18 and turnbuckle assembly 30.

The turnbuckle assembly 30 comprises support 34, mounted on the top plate 144 of beam unit 12*b*, and corresponding support 32, mounted on the top plate 145 of beam unit 12*a*. A threaded rod 36 is attached to support 34, opposite a similar threaded rod 38 attached to support 32. These rods are threaded complementarily to the interior threading of turnbuckle nut 141, which may be fixedly positioned by lock nut 40. The turnbuckle assembly permits the relative attitudes of the constituent beam units 12*a* and 12*b* to be adjusted vis-a-vis one another to achieve a selected relationship in use.

Thus, by adjusting the axial position of the turnbuckle nut 141 on the respective threaded rods 36 and 38, the relative attitudes of the constituent beam units may be adjusted to provide a bottom profile on the screeding surface which is linear, peaked or valleyed, to produce corresponding surface profiles on the concrete being screeded.

In the construction shown in FIG. 1, the constituent beam units 12*a* and 12*b* corporately form a central beam unit 12 which is connected at its outer ends to extension beam units 14 and 16, respectively, as a symmetrical arrangement.

Central beam unit 12 is coupled to the extension beam unit 16 by coupling means comprising bolt fasteners 22 and turnbuckle assembly 56. The turnbuckle assembly is similar to the construction illustratively described above in connection with the central beam unit, comprising supports 58 and 60, threaded rods 62 and 64, turnbuckle nut 66 and lock nut 68. Central beam unit 12 likewise is connected to extension beam unit 14 by coupling means comprising bolt fasteners 20, and a turnbuckle assembly 42 comprising supports 44 and 46, threaded rods 48 and 50, turnbuckle nut 54 and lock nut 52.

By means of the respective turnbuckle assemblies 42 and 56, the aforementioned problems of "droop" and uneven camber deflections caused by extended lengths of the screeding apparatus may be eliminated, by suitable adjustment of the respective turnbuckle nuts 54 and 66, to provide the extension beam units with any desired attitude relative to the central beam unit 12.

In the above-described construction, an integral elongated beam assembly is provided. The elements of the elongated beam are illustrated in FIG. 1 with reference to the extension beam unit 14, which as shown comprises a first flat horizontal plate portion 70 on the top of the beam, a hollow, tubular cylindrical section 74 located below the first plate portion 70 with its axis extending parallel to the first plate portion, and a second flat horizontal plate portion 72 on the bottom of the beam, below the tubular section and in a plane extending parallel to the first plate portion. The bottom plate portion 72 provides a screed element which at its ends enables the apparatus to be supported on forms. A first generally vertical rib 76 joins the first plate portion 70 to the tubular section 74. The generally vertical second rib 78 joins the tubular section 74 to bottom plate portion 72.

On the first plate portions 144 and 145 of the central beam unit 12, is mounted handle 90, connected to the respective flat plate portions by fastening means 92 and 94.

Also mounted on the top plate portion 144 is a motor assembly 96 which is employed to impart vibrations to the second plate portion of the screeding apparatus. The assembly comprises a gasoline engine 140 mounted on the top plate 144 by means of mounting flange 142 and fastening bolts 146. The shaft 148 of this engine has mounted thereon a pulley 138 accommodating a pulley belt 150 which is joined to pulley 154 at its other end, the latter pulley being mounted on shaft 156 extending from inner sleeve 152 and joined to bearing 160 by means of inner sleeve 158 comprising set screw securing means 162.

Figure 4:
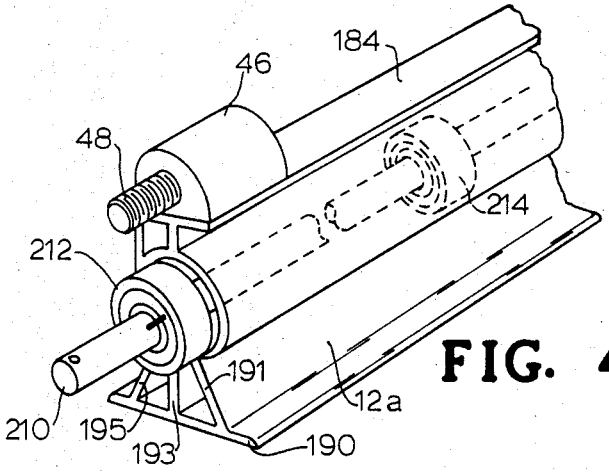
FIG. 4 is a perspective view of beam unit 12*a* of FIG. 3, omitting the tongue body coupling means, and further showing the means for imparting vibration to the screeding surface of the apparatus.

The details of this vibration imparting construction are further shown in FIG. 4 with reference to the beam unit 12*a*.

The central tubular section of the elongated beam is located and dimensioned so as to be able to directly serve as a housing for a loose bearing type vibrating shaft 210 of a type as described in applicant's U.S. Pat. No. 4,386,901, the disclosure of which hereby is incorporated by reference. The shaft comprises a series of shaft sections coupled to one another as disclosed in such prior issued patent, and in applicant's copending Ser. No. 888,522.

The interior space of the tubular section of the beam units receives a series of bearings 212, 214 mounted on the shaft 210 and spaced at intervals along and within the tubular section.

Referring again to FIG. 1, inner sleeves 152 and 158 secured by set screws 162 fit tightly on the vibrating shaft and mount bearings 160 at similar longitudinally spaced intervals but so as to purposely fit loosely within the tubular section. Thus, when the shaft section 156 is driven, via belt 150, pulleys 138 and 154, by engine 140, the shafts 156 and 210 rotate and vibrate within the beam units thereby imparting vibrations to the entire screed.

Figure 2:
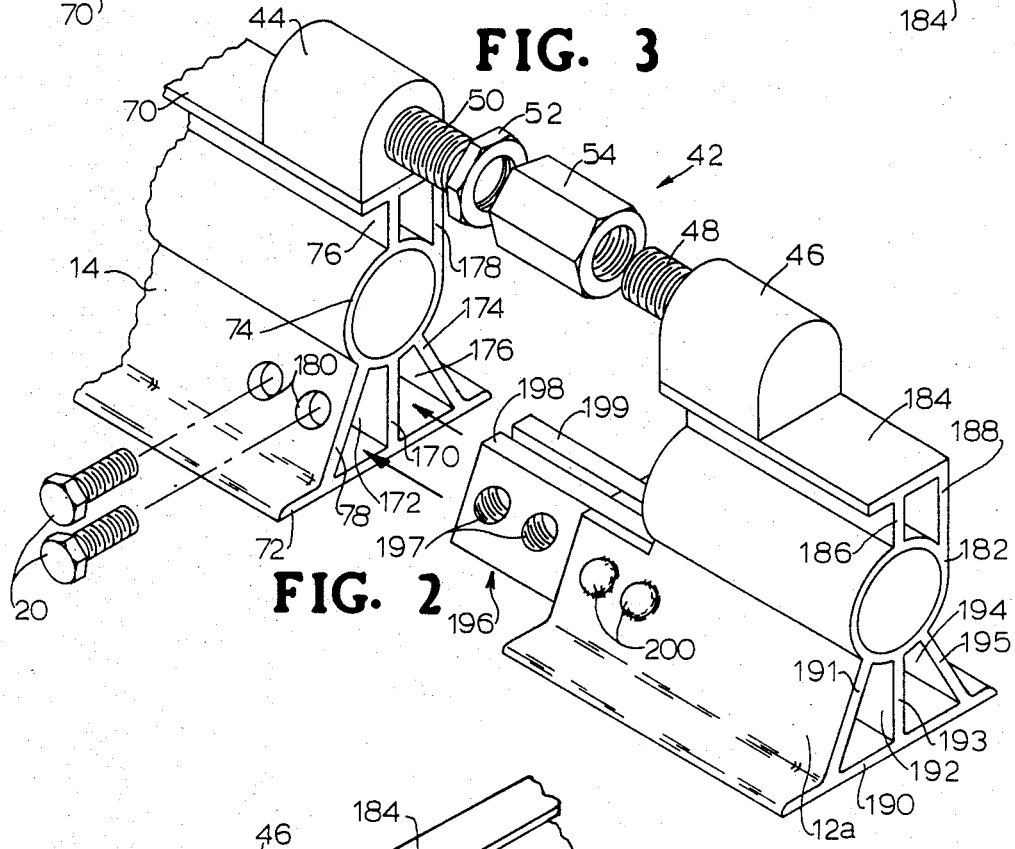
FIG. 2 is a perspective view of coupleable end portions of beam units of the FIG. 1 screed apparatus, illustrating the details of the coupling means and the optional attitude adjustment means associated therewith.

FIG. 2 shows the details of construction of the adjacent beam units 12*a* and 14.

Beam unit 12*a* comprises a tubular section 182 joined by generally vertical ribs 186 and 188 to flat top portion 184, on which is mounted the turnbuckle assembly support 46, as previously described. The tubular section 182 is also joined to bottom plate portion 190 by a set of generally vertical ribs 191, 193 and 195, in such manner forming enclosed passages 192 and 194 bounded by the tubular section, bottom plate portion, and associated generally vertical ribs.

Beam unit 14 is similarly constructed with upper ribs 76 and 178 joining the tubular section 74 to flat top plate 70, on which is mounted the turnbuckle assembly support 44. The tubular section 74 is joined to flat bottom plate 72 by means of the generally vertical ribs 78, 170 and 174, which as shown form respective longitudinally extending open passages 172 and 176 in the beam unit.

The beam units preferably are formed of a lightweight material such as aluminum, which may readily be formed by extrusion, to facilitate portability and ease of use.

The coupling means for securement of beam units 12*a* and 14 include, in addition to the turnbuckle assembly 42, two tongue bodies 198 and 199, each of which is adapted, by means of its size and shape, to closely fit within the respective longitudinally extending open passages in the beam units. Thus, tongue body 198 is adapted to fit at a first end within an outer portion of the longitudinal passage 192, while tongue body 199 is similarly disposed within an outer portion of the longitudinally extending passage 194. In such fashion, the outer ends of the tongue bodies protrude from beam unit 12*a* for insertion into corresponding longitudinal passages 172 and 176 of beam unit 14. The tongue bodies 198 and 199 together forming tongue assembly 196 may each be permanently fastened to beam unit 12*a*, such as by means of the welded bolts 200 which are bonded to the outer surface of rib 191 and extend through the respective tongue bodies, by means of openings therein similar to those shown on the protruding tongue body portions (openings 197).

The tongue bodies thus may be permanently affixed to beam unit 12*a* and detachably secured to beam unit 14 by insertion of the protruding ends of the tongue bodies into the receiving passages 172 and 176, respectively, following which the bolt fasteners 20 may be passed through openings 180 and corresponding openings (not shown) in ribs 170 and 174, and through the transversely extending openings 197 in the respective tongue body inserted portions. The transversely extending openings in the tongue body protruding portions may suitably be threaded as shown to receive the bolt fasteners 20, which are complementarily threaded with respect thereto. In such manner, the respective beam units 12*a* and 14 may readily be assembled and disassembled, to provide a screed apparatus of a predetermined length as necessary or desirable for the intended end use.

In some instances, it may be desired to detachably secure the tongue bodies to each of the adjacent beam units, rather than being permanently secured at one end as shown in the FIG. 2 embodiment. However, in most applications, it will be desired to utilize the construction shown in FIG. 2 in which a first end of each tongue body is permanently secured to one of the adjacent beam units and the other end is detachably secured to the other of the adjacent beam units.

Further, it may be satisfactory in some instances to provide only a single tongue body, even in instances where a multiplicity of lower ribs are provided to form a series of longitudinally extending open passages, and it is also within the purview of the invention to utilize other and greater numbers of tongue bodies depending on the number of ribs employed and the number of longitudinal open passages thereby formed.

Figure 5:
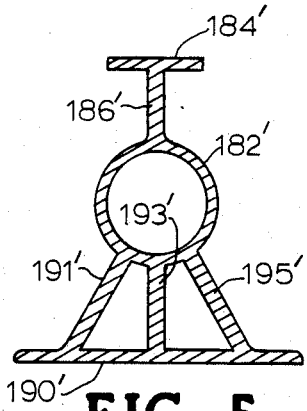
FIG. 5 is an end elevation cross section view of a modified beam unit according to another embodiment of the invention.

FIG. 5 shows a modified screed beam unit, in which only a single upper rib 186' is utilized to join top plate 184' to tubular section 182', while three lower ribs 191', 193', and 195' join the tubular section 182' to the bottom plate 190'. It will be recognized that the number of upper ribs may be varied, analogous to the lower ribs as described in the preceding paragraph.

It is seen that the tongue bodies, providing a close fit within the associated longitudinally extending open passages between corresponding ribs in adjacent beam units, provide a connection which is simple in construction, and is readily effected to yield a coupled beam comprising solidly connected assembled beam units. Further, the closely fitting character of the tongue bodies and their significant mass relative to the thin strap elements utilized in the construction taught in copending application Ser. No. 888,522, yields a superior capability in transmitting vibrations throughout the unit without significant susceptibility to loosening of the coupling means, even after prolonged operation of the device.

It will be recognized that any suitable means for imparting vibrations to the lower plate portions of the screed according to the present invention may be utilized, other than the means illustratively shown and described in connection with FIGS. 1–4 herein. For example, the screed may utilize a shaft mounted in the tubular section in snugly-fitted bearings, with eccentric weights mounted on the shaft to establish the required vibration when the shaft is rotated.

When the central beam unit, having mounted thereon handle means, and a motor drive means for imparting the requisite vibration to the lower plate portion, is joined to extension beam units, an integral beam element extending the full length of the screed is formed, which, without requiring additional or auxiliary structure, provides a surface for supporting the screed on forms, a housing for a vibrating shaft and associated bearing, and a bottom flat screed surface.

Thus, the assembly according to the present invention provides an easily maintained, highly portable, low-cost, lightweight and easily manufactured and operated screed, in which the attitude of adjacent beam units may be adjusted relative to one another to provide any predetermined surface profile in the concrete being screeded, e.g., crowns and/or valleys, as well as linear profiles, and in which deflection of the overall beam, which would otherwise occur due to weight and load considerations, may be eliminated by appropriate adjustment of the turnbuckle connector means herein disclosed. Further, the tongue body coupling means of the present invention facilitates the ready assembly and disassembly of constituent adjacent beam units, whereby a predetermined length of the beam may be provided in a quick and simple manner for a given screeding application.

Although preferred embodiments of the invention have been shown and described in detail, it will be apparent that other modifications, variations, and embodiments are possible, and all such modifications, variations and embodiments are therefore to be regarded as being within the spirit and scope of the invention.

What is claimed is:

1. A lightweight, portable concrete screed for screeding a width of concrete confined by forms comprising:

(a) an elongated beam characterized by:

(i) extending in length for the full width of the concrete to be screeded;

(ii) being made up of a plurality of interconnected longitudinally aligned extruded beam sections of similar cross section at least one of which referred to as the motor section is shorter in length than each other section;

(iii) having a first flat horizontal plate portion on the top of each beam section;

(iv) having a hollow, tubular cylindrical section extending through each beam section and located below the said first plate portion thereof with the axis thereof extending parallel to said first plate portion;

(v) having a second flat horizontal plate portion on the bottom of each beam section extending from one beam section to the next below said tubular section for the length of said beam and in a plane extending parallel to said first plate portion and suitable for service as a screed and at the ends thereof for supporting said beam on forms;

(vi) having at least one generally vertical first rib extending through each beam section and joining the said first top plate portion and tubular section thereof; and (vii) having generally vertical second ribs extending through each beam section between and joining the said tubular section and said second plate portions thereof, and defining therewith an open longitudinally extending passage between each pair of adjacent said second ribs;

(b) means for rigidly interconnecting said beam sections one to the other, comprising:

(i) a tongue fixedly secured at one end within each said passage of a first beam section with the opposite end of said tongue extending from said first beam section and closely fitted within each said passage of a second beam section; and (ii) means for removably securing the said opposite end of said tongue to said second beam section;

(c) a shaft extending for the length of and rotatably housed within the said tubular section of said beam;

(d) means mounted on said shaft for imparting vibration thereto when rotated;

(e) a motor mounted on said first horizontal plate portion of said motor section and secured thereto;

(f) drive connection means between said motor and shaft enabling said motor to drive said shaft and impart vibrations to said second plate portion; and (g) at least one handle secured to said first plate portion for guiding said screed.

2. A concrete screed as claimed in claim 1 wherein said passages comprise a pair of passages and said opposite end of said tongue is formed with a pair of tongue members adapted to be received within and be releaseably secured within said pair of passages.

* * * * *